US007059362B2

(12) United States Patent
Koons et al.

(10) Patent No.: US 7,059,362 B2
(45) Date of Patent: Jun. 13, 2006

(54) ADAPTABLE HAND OPERATED SAFETY CABLE TOOL

(75) Inventors: Kirk C. Koons, Orlando, FL (US); Walter J. Plyter, Maitland, FL (US)

(73) Assignee: Daniels Manufacturing Corporation, Orlando, FL (US)

( * ) Notice: Subject to any disclaimer, the term of this patent is extended or adjusted under 35 U.S.C. 154(b) by 237 days.

(21) Appl. No.: 10/686,902

(22) Filed: Oct. 16, 2003

(65) Prior Publication Data

US 2005/0081946 A1 Apr. 21, 2005

(51) Int. Cl.
*B21F 9/02* (2006.01)

(52) U.S. Cl. ..... 140/123.5; 140/123.6; 29/282

(58) Field of Classification Search ..... 140/123.5, 140/123.6; 29/282
See application file for complete search history.

(56) References Cited

U.S. PATENT DOCUMENTS 3,670,782 A * 6/1972 Kabel ..... 140/93.2
5,345,663 A * 9/1994 Scruggs ..... 29/282
5,361,475 A 11/1994 Scruggs
5,511,589 A * 4/1996 Scruggs ..... 140/93.2
6,073,664 A * 6/2000 Angarola ..... 140/123.5

* cited by examiner

*Primary Examiner*—Derris Banks
*Assistant Examiner*—Debra Wolfe
(74) *Attorney, Agent, or Firm*—James H. Beusse; Beusse Wolter Sanks Mora & Maire, P.A.

(57) ABSTRACT

An adaptable hand operated tool for tensioning safety cable to a predetermined tension limit, crimping a ferrule onto the cable, and cutting the cable. The tool comprises a body for adapting the tool to a hand operated hydraulic tool, a cable tensioner, and an elongated, removable nose. The cable tensioner comprises a wheel for applying tension to a cable wrapped around the wheel, and a clutch for prohibiting a rotational force from being applied to the wheel when a predetermined cable tension is applied. The elongated has an aperture for receiving a ferrule and passing the cable therethrough. A plunger is reciprocally operative in the nosepiece to crimp the ferrule on the safety cable and simultaneously severing a free end of the cable. The plunger is actuated by a piston of a hand operated hydraulic base tool.

12 Claims, 6 Drawing Sheets

ADAPTABLE HAND OPERATED SAFETY CABLE TOOL

FIELD OF THE INVENTION

The present invention relates to an apparatus for attaching safety cables to releasable fasteners and, more particularly, to an adaptable apparatus for tensioning, locking and terminating safety cables.

BACKGROUND OF THE INVENTION

Various types of machinery are subject to vibration that can loosen nuts and bolts. Safety wire has long been used as protection to resist such loosening. In such use, safety wire secures two or more parts together so that loosening of one part is counteracted by tightening of the wire. Typically, a single wire is passed through an aperture in a nut or bolt, the free ends twisted together up to another part, one of the ends inserted through an aperture in the another part and the ends again twisted. The standards for utilization of safety wire are critical and are set forth in Aerospace Standard AS567, entitled "General Practices for the Use of Lockwire, Key Washers and Cotter Pins," available from the Society of Automotive Engineers, Inc., 400 Commonwealth Dr., Warrendale, Pa.

Safety wire or lockwire, as it is sometimes known, has several known problems. More recently, there has been developed an improved locking system using safety cable. Safety cable is a stranded cable having a termination on one end allowing the cable to be pulled to a predetermined tension through the aforementioned apertures in nuts and bolts. After tensioning, the free end of the cable must be terminated to hold the tension and cleanly severed to minimize any possibility of snags on loose wires. One such tool to perform this operation is commercially available under the trade name "Safe-T-Cable™" from the assignee of the current application, Daniels Manufacturing Corporation, and is described in U.S. Pat. No. 5,345,663.

Safety cable is utilized on bolts and fasteners that are often located in cramped or minimally accessible locations. Accordingly, it is also desirable to provide a tool which is modular to provide interchangeable tool lengths and is reduced in size to access cramped locations. Further, in typical applications, the installation of safety wire involves a considerable amount of time and manual operation of a tool, resulting in operator fatigue. Accordingly, it is desirable to provide a tool where the required hand force to operate the tool is reduced.

SUMMARY OF THE INVENTION

A tool for tensioning safety cable to a mechanically set tension limit and for terminating the cable when the cable has been tensioned to the mechanically set limit is described herein as including a manual actuator for gripping and pulling the cable to the tension limit, and a hydraulically assisted actuator for crimping a ferrule onto the cable when the tension limit has been reached, the hydraulically assisted actuator being operative to sever a free end of the cable concurrently with crimping of the ferrule. The toll may also include a tensioning wheel for retaining cable wrapped around the wheel and allowing tension to be applied to the cable by manual rotation thereof, and a clutch for transferring a rotational force to the wheel, the clutch preventing rotational force from being applied to the wheel when a predetermined cable tension has been reached. The tool may further include a plunger for progressively crimping the ferrule as the hydraulically assisted actuator is operated and a shearing edge, operative in conjunction with a ferrule edge, for severing the free end of the cable as the ferrule edge is forced past the shearing edge by the plunger as the ferrule is being crimped.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
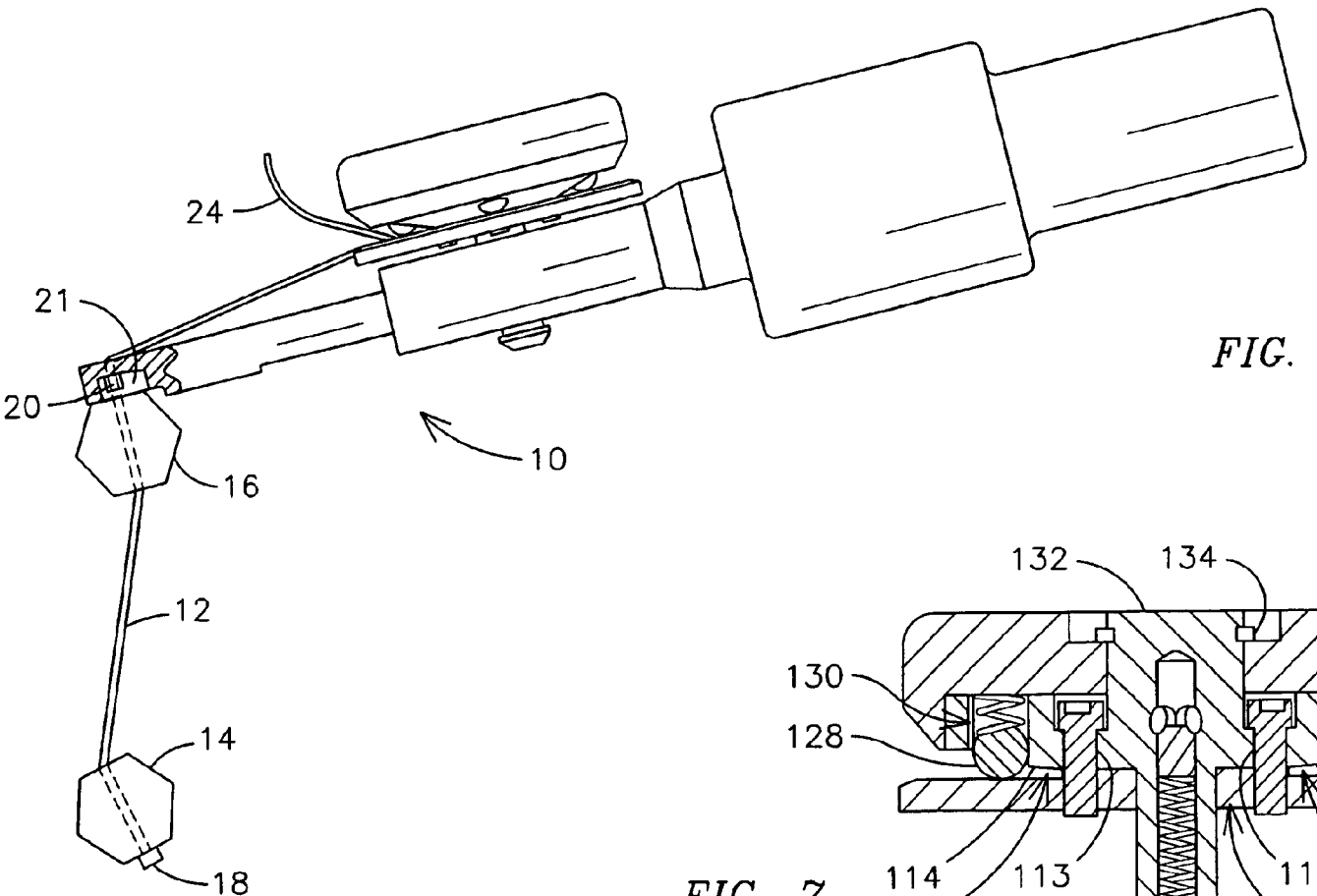
FIG. 1 is a top planar view of a tool according to the present invention.

FIG. 1 is a functional hardware diagram of one form of the present invention. Referring to the figures in general, and in particular to FIGS. 2 and 3, there is illustrated a top view and a cross-sectional side view of a safety cable tool 10, respectively. The safety cable tool is capable of being operatively attached to a hydraulically operated base tool 26, such a hydraulic pump assembly, part number HD38, available from Daniels Manufacturing Corporation, and generally includes a body 28, a cable tensioner assembly 30, and a nose 32. FIG. 1 includes a safety cable 12 passing through apertures in each of the bolt heads 14 and 16. A ferrule 18 is clamped at one end of cable 12 to prevent it from being pulled through the bolt apertures. A second ferrule 20 is seated in an aperture 21 in the nosepiece 22 of tool 10 in a position to be crimped onto cable 12 when a predetermined tension has been pulled on cable 12 by a cable tensioner assembly 30. The free end 24 of cable 12 is coupled to the cable tensioner assembly 30 and to apply tension to the cable 12. Specifically, the free end of the cable is wrapped around the cable tensioner assembly 30 and wedged so that tension can be tangentially applied by rotating the cable tensioner assembly 30 in the same direction as the cable 12 is wrapped. For example, if the cable 12 is wrapped clockwise around the cable tensioner assembly 30, the assembly 30 is rotated clockwise to further wrap the cable 12 and apply increased tension. When a predetermined tension (such as a tension between 15and 25 pounds) is applied to the cable 12, the cable tensioner assembly 30 prevents further tensioning to be applied, while maintaining the predetermined tension on the cable 12. The wrapping of the cable 12 about the cable tensioner assembly 30 also prevents the cable from loosening while the ferrule 18 is being crimped.

Figure 7:
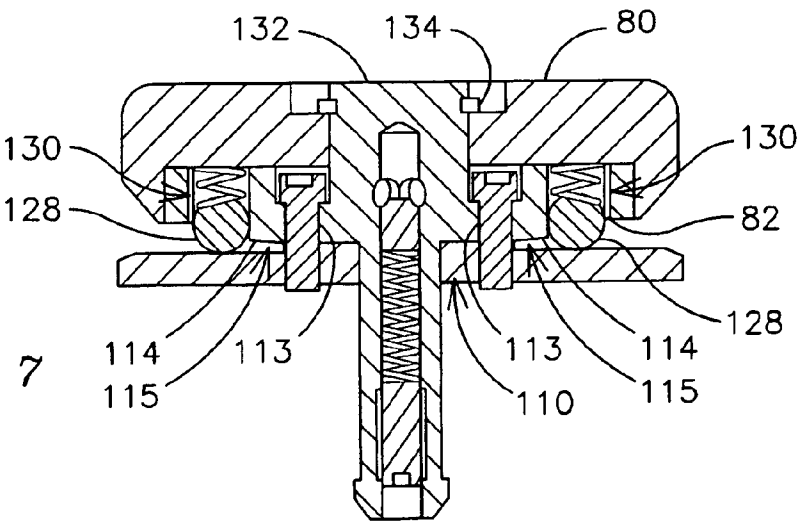
FIG. 7 depicts a cross sectional view of the cable tensioning assembly of FIG. 5 taken along a rotation axis.
Figure 2:
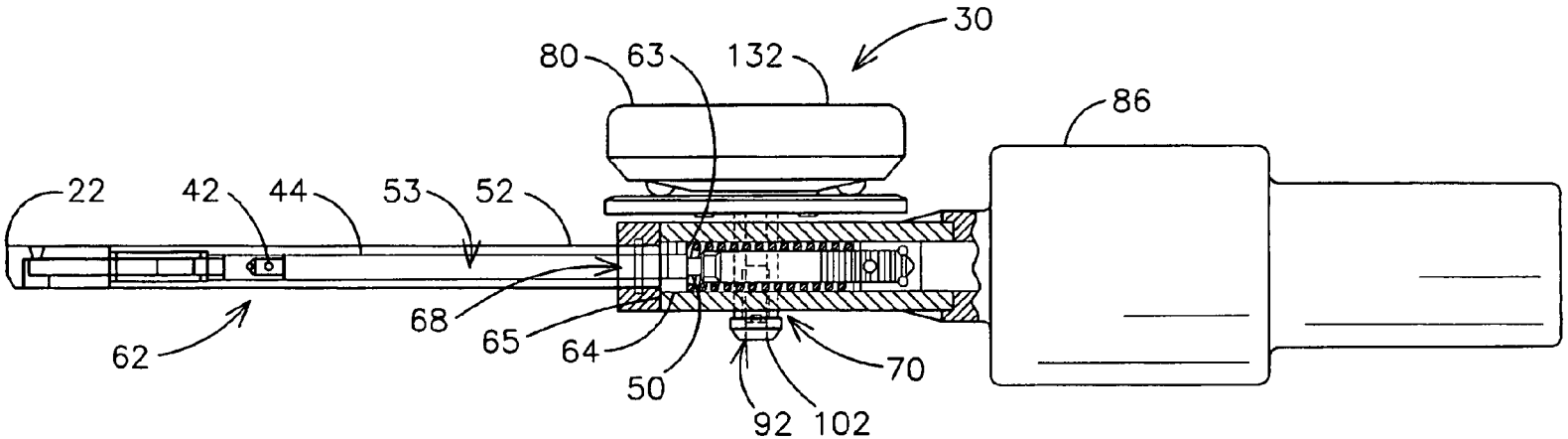
FIG. 2 is a cross-sectional top view of the tool of FIG. 1.
Figure 5:
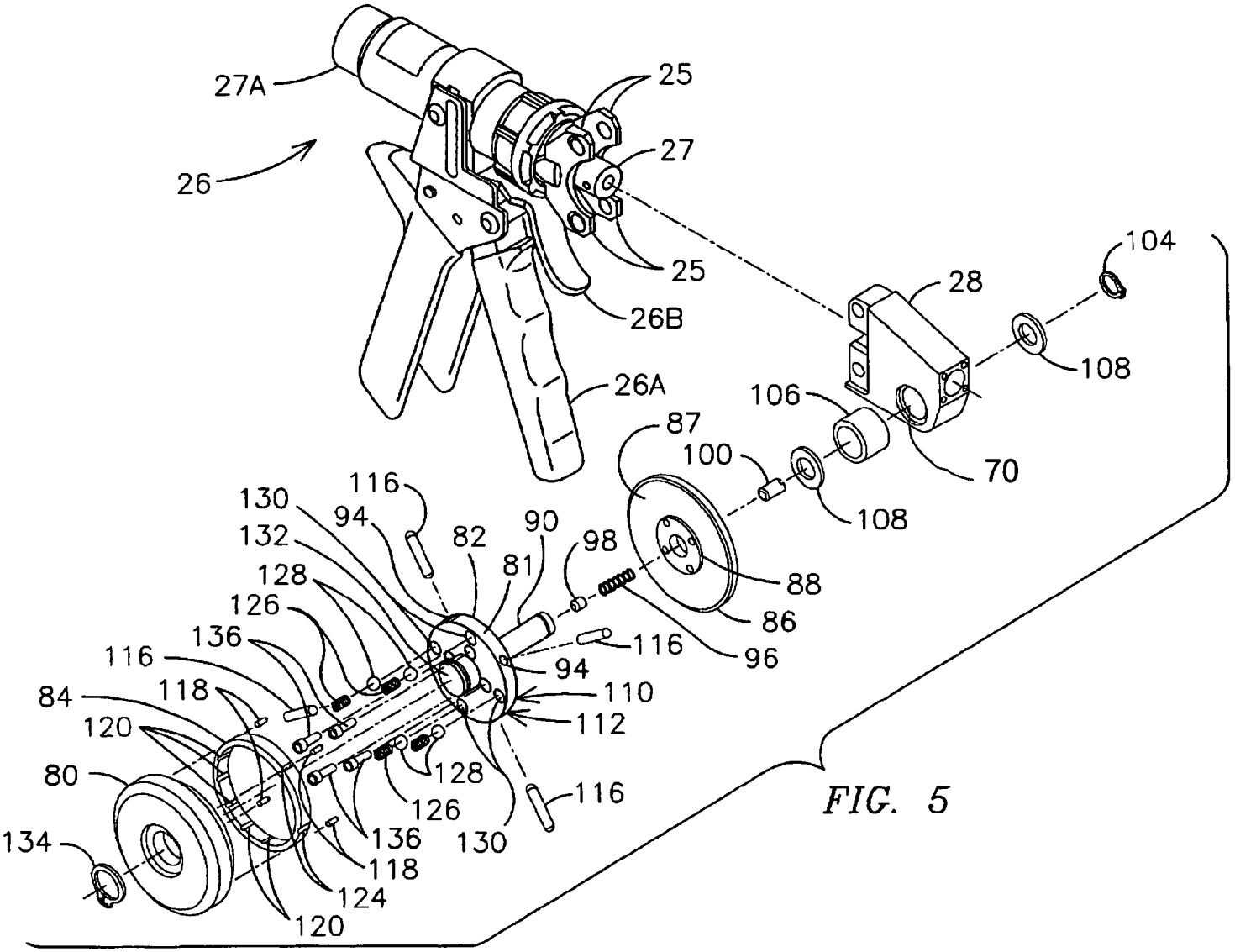
FIG. 5 is a partial exploded view of the tool of FIG. 1 including the tool body, the cable tensioner assembly, and an exemplary hydraulically operated base tool.
Figure 6:
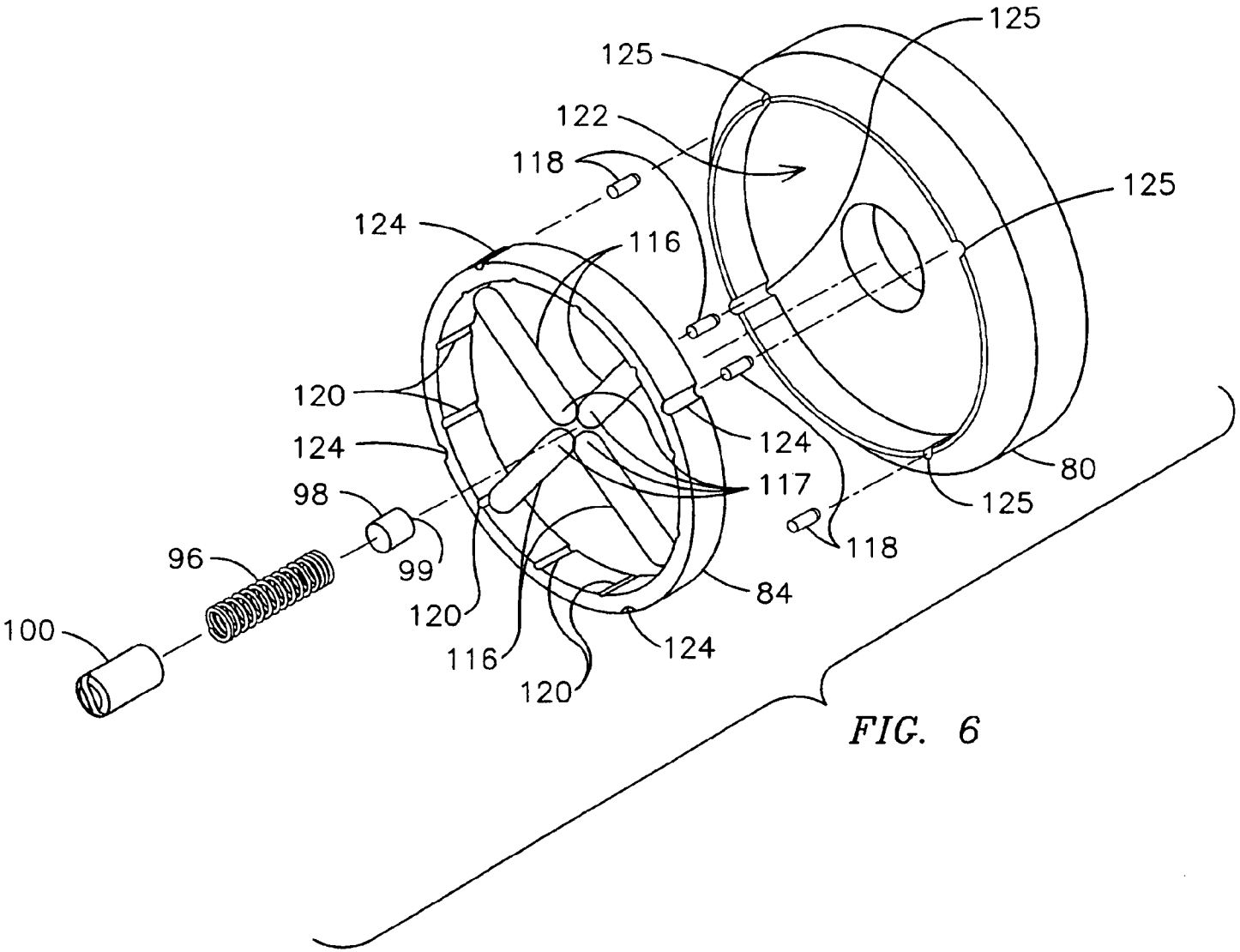
FIG. 6 is a partial exploded view of the cable tensioner assembly of FIG. 5 with some details omitted for clarity.

The cable tensioner assembly 30 will now be described in further detail with respect to FIGS 2, 5, 6, and 7. FIG. 2 depicts a cross-sectional top view of the tool of FIG. 1 and FIG. 5 is a partial exploded view of the tool of FIG. 1 including the tool body, the cable tensioner assembly, and an exemplary hydraulically operated base tool. Fig 6 is a partial exploded view of the cable tensioner assembly 30 of FIG. 5 with some details omitted for clarity, and FIG. 7 depicts a cross sectional view of the cable tensioning assembly 30 of FIG. 5 taken along a rotation axis. The cable tensioning assembly 30 further includes a knob 80, a clutch tensioning force wheel 82 that includes an axle 90, a clutch ring 84, and a faceplate 86. The cable tensioner assembly 30 is rotatably mounted in the tool body 28 generally perpendicular to the elongate axis of the nose 32, so that the axle 90 of the wheel 82 extends substantially through an opening 70 in the body 28, allowing access of the axle end 102 at the opposite side of the body. In an embodiment, the axle 90 rides in a ring bearing 106 mounted within the body 28 and sandwiched between two bearing washers 108. In addition, a circumferential groove is formed in the axle near the end 102 to allow fastening of a retaining ring 104 to rotatably retain the axle 90 in the body 28.

On the body side 110 of the wheel 82, the surface of the wheel 82 has a flat portion 113 extending radially away from the axle 90, then the surface assumes a sloping profile extending from the flat portion 113 to a rim 81 of the wheel 82 forming a flared portion 114. The flat portion 113 is configured to allow attaching a faceplate 86 thereto, with, for example, screws 136. An attachment portion 88 of the faceplate 86 is a raised cylindrical platform having a height perpendicular to a face 87 of the faceplate 86. In an aspect of the invention, the height may be slightly smaller than the diameter of the safety cable 12. When the faceplate 86 is attached to the wheel 82, the face 87 of the faceplate 86 and the flared portion 114 forms a gripping slot 115 tapering to a relatively smaller width toward the axle 90. Accordingly, the flared portion 114 acts to wedge a safety cable 12 wrapped circumferentially in the gripping slot 115, thereby retaining the cable 12 so that tension can be applied by rotating the knob 80.

The axle 90 includes an axle bore 92 open on the axle end 102 and intersecting radial passageways 94 extending from the axle bore 92 radially outward and opening at the rim 81 of the wheel 82. The axle bore 92 is partially internally threaded on the axle end 102 to accommodate a threaded adjustment screw 100. Elongated clutch tensioning force pins 116 are slidingly installed in the radial passageways 94 so that an end 121 of the clutch tensioning force pin 116 protrudes from the rim 81 of the wheel 82, and the other end 117 protrudes into the axle bore 92. In an aspect of the invention, the end 121 of the clutch tensioning force pin 116 may be hemispherically shaped. A spring actuator 98, having an angled tip 99, such as a 45 degree chamfer, is positioned in the bore 92 so that the angled tip 99 contacts the ends 117 of the tensioning force pins 116 extending radially into the bore 92. In an aspect of the invention, the ends 117 may be angled, such as with a 45 degree chamfer, to complementarily abut the angled tip 99 of spring actuator 98. A compression spring 96 followed by an adjustment screw 100 (forming an adjustable spring seat) are positioned in the bore 92 to adjustably maintain an axial force on the spring actuator 98 that is transferred, by the angled tip 99 of the spring actuator 98, to a radial force acting radially outward on ends 117 of the clutch tensioning force pins 116.

The clutch ring 84 fits rotatably around the rim 81 of the wheel 82 and, as more clearly shown in FIG. 6, includes indentations 120 laterally formed and uniformly spaced in the inner diameter of the ring 84. The indentations 120 movably accommodate the ends 121 of the clutch tensioning force pins 116 radially protruding from rim 81 of the wheel 82. For example, the indentations may have a circular cross section sized to engage a hemispherically shaped end 121 of the clutch tensioning force pin 116. The ends 121 of the clutch tensioning force pins 116, forced into the indentations 120 by action of the spring actuator 98 and the compression spring 96, prevent rotation of the clutch ring 84 around the wheel 82 until a rotational force is applied sufficient to overcome the force of the compression spring 96 communicated through the spring actuator 98 to the clutch tensioning force pins 116 lodged in respective indentations 120. When sufficient rotational force, or tension, is applied to the clutch ring 84, the sides of the indentations 120 act to radially displace the protruding clutch tensioning force pins 116 in a direction towards the axle bore 92 and out of the indentations 120, so that the clutch ring 84 rotates about the wheel 82 as long as sufficient rotational force is applied. The force acting on the clutch tensioning force pins 116 to keep the pins 116 lodged in the indentations 120, and, correspondingly, the rotational force required to overcome the radial force on the pins 116, can be adjusted by threading the adjustment screw 100 in or out of the axle bore 92 to alter the compression of the spring 96, accessed via an axle bore 92 opening at the axle end 102 as shown FIG. 5. For example, as the adjustment screw 100 is tightened, increasing pressure is exerted on the spring actuator 98 corresponding to the compression on the spring. The force on the spring actuator 98 is transferred longitudinally to the tensioning force pins 116.

In one form, the spring actuator 98 may have a 45 degree conical tapered end to contact the ends of the tensioning force pins 116 positioned within the axle bore 92. In another aspect, the ends of the tensioning force pins 116 positioned within the axle bore 92 may have a 45 degree conical taper corresponding to the 45 degree conical taper of the spring actuator 98. The longitudinal force applied to the respective ends of the tensioning force pins 116 positioned within the axle bore 92 is then transferred to the indentations 120 in the clutch ring 84, resulting in increased tensioning force required to force the ends of the tensioning force pins 116 from respective indentations 120. Accordingly, the clutch tensioning force pins 116, the spring actuator 98, the compression spring 96, and adjustment screw 100 comprise, with clutch tensioning force wheel 82, the tension setting means for controlling tension in cable 12.

The clutch ring 84 also includes lateral grooves 124 formed in the outside diameter for installing knob mounting pins 118. The clutch ring 84 and wheel 82 fit within a circular recess 122 formed in one side of the knob 80. The knob 80 includes lateral grooves 125 on the inside diameter of the recess 122 corresponding to the lateral grooves 124 on the clutch ring 84 to tangentially fix the clutch ring 84 within the recess 122 by inserting appropriately sized pins 118 into the grooves 124,125 when the clutch ring 84 and wheel 82 are installed. Accordingly, the knob 80 can move coaxially with respect to the elongate axis of the axle 90 as can be seen in FIG. 5. The axle stub 132 is circumferentially grooved to accept a retaining ring 134 to rotatably retain the knob 80 on the axle stud 132.

In an aspect of the invention depicted in FIG. 7, ball keepers 128 are provided to retain a cable 12 wrapped around the tensioner assembly 30 and forced into the gripping slot 115 as the tensioner assembly 30 is rotated to apply tension to the cable 12. The ball keepers 128 are positioned circumferentially in bores 130 transversely formed in the wheel 82 so that the ball keepers 128 partially extend from the bores on 130 on the body side of the wheel 82, and are in movable contact with the face 87 of the faceplate 86. The ball keepers 128 are urged through the respective bores 130 towards the face 87 by springs 126 held in place by a face of the recess 122 of the knob 80 when the knob 80 is assembled to the wheel 82 on an axle stub 132. The ball keepers 128 retain the safety cable 12 in the gripping slot 115 as the safety cable 12 is forced into the slot during a tensioning process. The springs 126 allow the ball keepers 128 to move perpendicularly away from the face 87of the faceplate 86 to allow passage of the cable 12 into the gripping slot 115 as the cable 12 is drawn tighter around the tensioning assembly 30 during tensioning. After the safety cable 12 is cut, a cut off portion of the cable can be unwound from the gripping slot 115 for removal.

When sufficient tension is applied to a cable 12 wrapped around the tensioner assembly 30, the clutch ring 84 and, correspondingly the knob 80, will slip around the rim 81 of wheel 82 by forcing the ends 121 of the clutch tensioning force pins 116 out of the indentations 120 in the clutch ring 84. Accordingly, when the proper tension has been applied to the cable 12, further tensioning of the cable 12 is prevented by allowing the knob 80 and clutch ring 84 to slip tangentially about the clutch tensioning force wheel 82.

Figure 3:
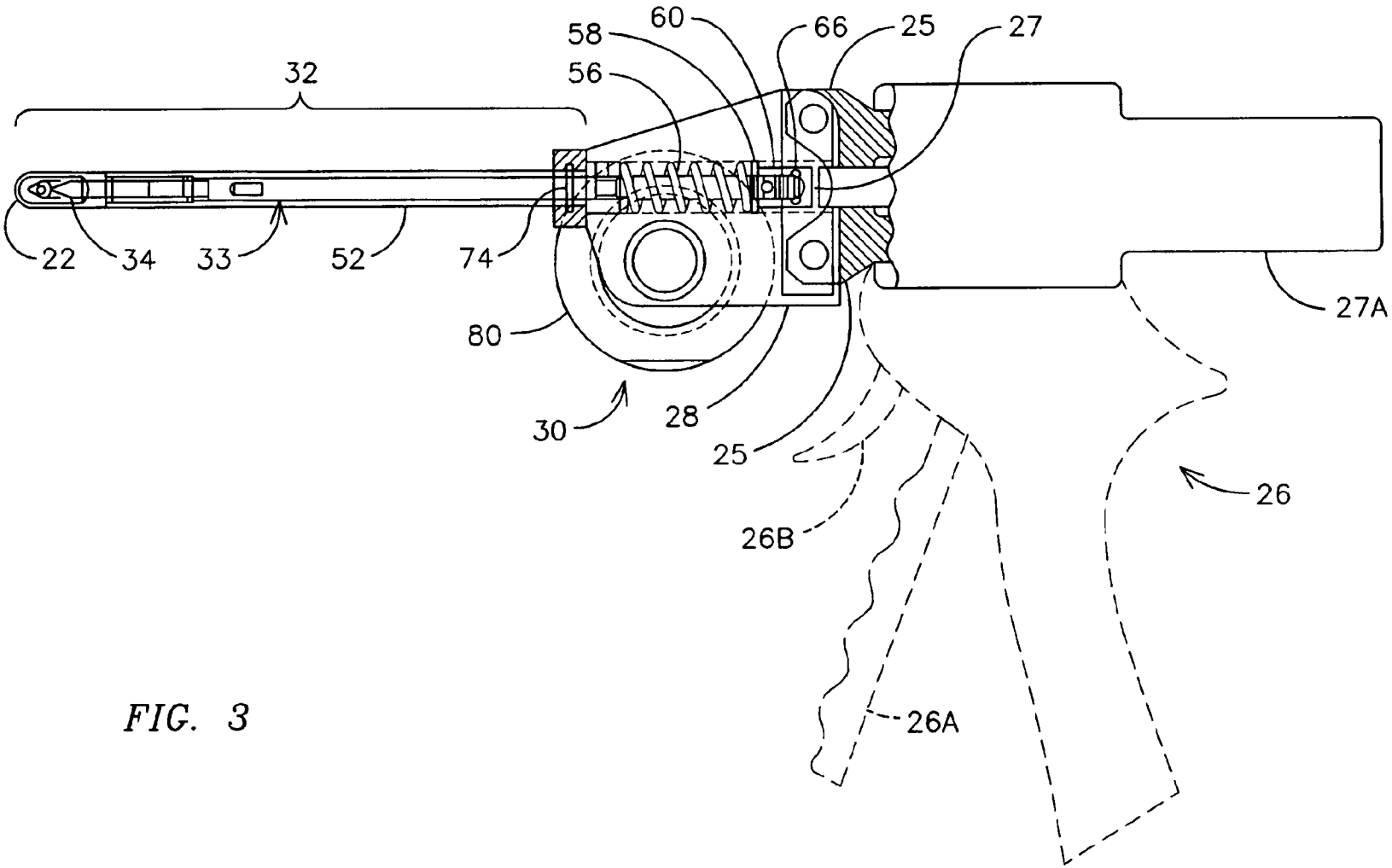
FIG. 3 is a cross sectional side view of the tool of FIG. 1.
Figure 8:
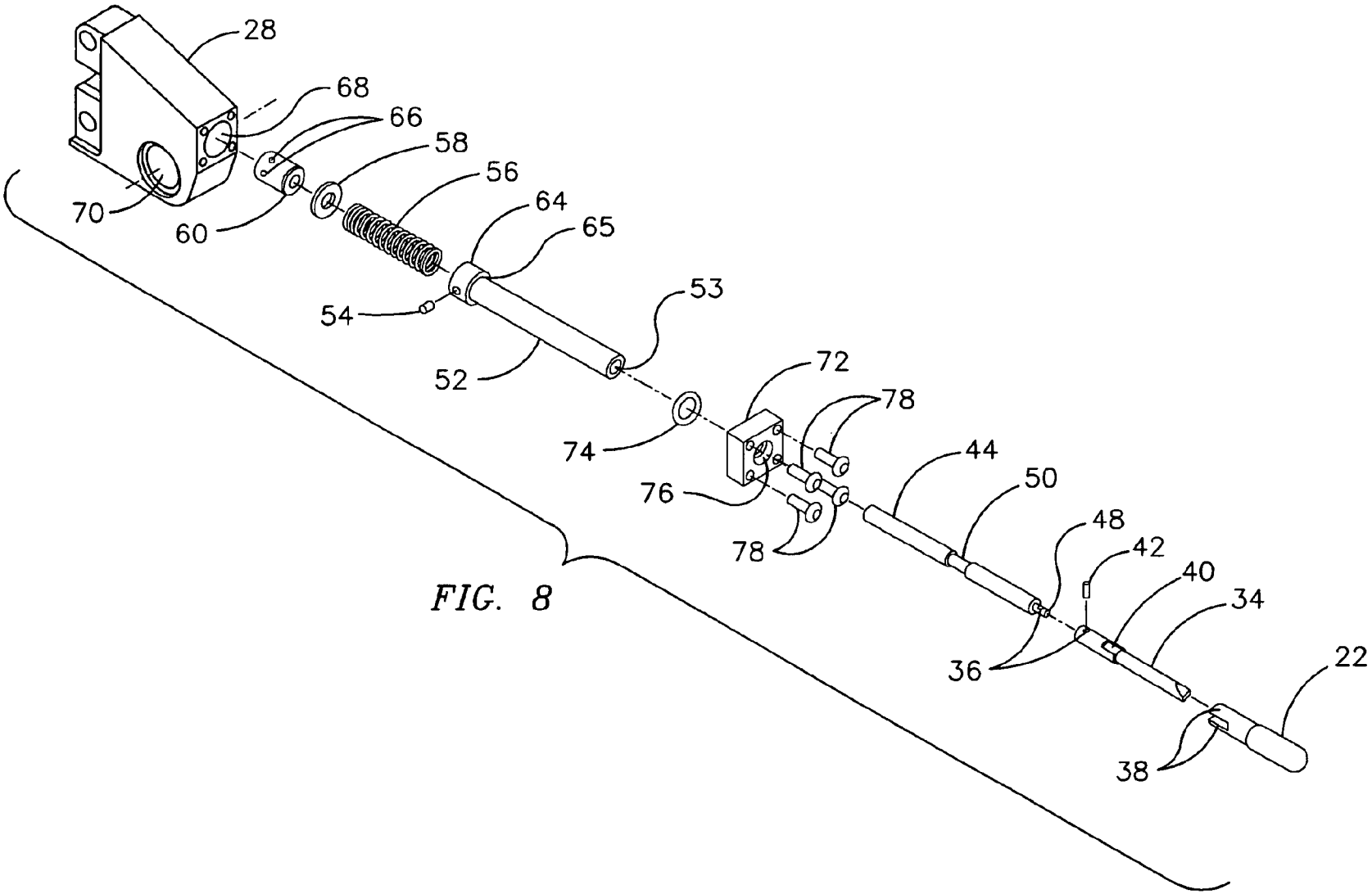
FIG. 8 is a partial exploded view of the tool of FIG. 1 including the tool body and the nose.

The nose 32 of the tool will now be described in further detail with respect to FIGS. 2, 3, and 8. FIG. 2 depicts a cross-sectional top view of the tool of FIG. 1, and FIG. 3 depicts a cross-sectional side view of the tool of FIG. 1. FIG. 8 is a partial exploded view of the tool of FIG. 1 including the tool body and the nose. The nose 32 of the tool generally includes a nosepiece 22, an indenter 34, a push rod 44, a nose extension 52, a spring 56, and an adjustment barrel 60. The indenter 34, push rod 44, and adjustment barrel 60 together form a plunger assembly 33, while the nosepiece 22, nose extension 52 and spring 56 together form a nosepiece assembly 62. It should be noted that when referring to parts comprising the nose assembly 32, the "distal end" of a part is the end that, when assembled in the tool, points away from the tool. Conversely, the "proximal end" of a part is the end that, when assembled in the tool, points towards the tool. As described earlier, a ferrule 20 fits within aperture 21 in the distal end of nosepiece 22. When the plunger assembly 33, is actuated by a piston 27 on the base 26 tool, the distal end of indenter 34 is pushed into the aperture 21, thereby crimping the ferrule 20 about the cable 12. The depth of the crimp may be adjusted using the adjustment barrel 60. The aperture 21 is larger on an entrance side of the nosepiece than it is on the exit side.

Figure 4:
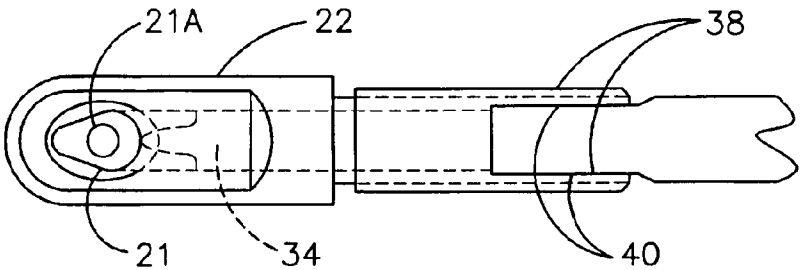
FIG. 4 is an enlarged view of the distal end of the nosepiece of the tool of FIG. 1.

FIG. 4 is an enlarged view of the nosepiece 22 showing the entrance side having a large open area, while the exit side has a small opening 21A just suitable for passage of cable 12. The entrance side opening has an oval configuration extending toward the distal end of nosepiece 22. Accordingly, as plunger assembly 33 is actuated, it not only crimps ferrule 20 but drives the edge of the ferrule 20 past the exit side opening 21A. The ferrule edge and exit side opening edge combine to act as a shear to automatically sever the free end portion 24 of the cable 12 extending out of the ferrule 20. The tool 10 thereby crimps the ferrule 20 and severs the free end 24 of the cable in a single operation. In one aspect of the invention, shearing of the free end of the cable 24 occurs at fixed, predetermined crimp depth that is less than crimp depth required to maintain a minimum required tensile strength of the installed safety cable 12, but more than a minimum depth of crimp necessary to prevent the cable 12 from pulling out of the ferrule 20 as the cable 12 is sheared during crimping. Accordingly, the distance of the exit hole 21A in relation to an edge of a ferrule 20 positioned in the aperture 21 is fixed so that an initial crimping depth is applied by the indenter 34 before shearing of the cable 12 between the hole 21A and the edge of the ferrule 20 is initiated. Once the initial crimping depth is applied so the cable 12 will not pull out of the initially crimped ferrule 20, shearing occurs as the indenter 34 crimps the ferrule 20 to a final desired depth so that a minimum required tensile strength is maintained. As a result, shearing takes place at the same crimp depth regardless of the final crimp depth that can be adjusted using the adjustment barrel 60.

In one aspect of the invention, the proximal end of the nosepiece 22 has two alignment ears 38 configured to slidably interlock with flat portions 40 of the indenter 34 to align the plunger assembly 33 in a fixed angular orientation with respect to the aperture 21 of the nosepiece 22 for proper crimping of the ferrule 20. The proximal end of the nosepiece 22 is externally threaded to mate with internal threads on a nose extension 52 so that the nosepiece 22 can be screwed into the distal end of the nose extension 52.

Returning now to FIGS. 2, 3, and 8, the proximal end of the indenter 34 is formed to receive a stud 48 on the distal end of the push rod 44 so that the indenter can be attached to the pushrod 44. A bore 36, transversely piercing the indenter 22 and the stud 48, allows insertion of pin 42 to firmly affix the indenter 34 to the distal end of the push rod 44. A middle portion of the push rod is cut out into a waist 50 to accommodate a reciprocal movement limiting set screw 54 when the pushrod 44 is slidably mounted within the nose extension 52. The proximal end of the push rod 44 is threaded externally to mate with internal threads on adjustment barrel 60, so that when the proximal end of the pushrod 44 is passed through the nose extension 52 and spring 56, the pushrod 44 can be screwed into the adjustment barrel 60.

The nose extension 52 includes a passageway 53, extending from the distal end to the proximal end, wherein the internal diameter of the passageway 53 is slightly larger than the outside diameter of the pushrod 44 to allow reciprocal movement of the pushrod 44 when the pushrod is assembled within the nose extension 52. As previously described, the distal end of the nose extension 52 is threaded to receive the complementarily threaded proximal end of the nosepiece 22. The proximal end of the nose extension 52 includes a circumferentially enlarged cylindrical head 64 to provide a contact surface 63 for the compression spring 56, and a flange 65 to prevent the nose extension 52 proximal end from being forced out of the tool body 28 when the plunger assembly 33 is activated. In addition, the head 64 is radially bored and tapped to accommodate a setscrew 54 for reciprocally retaining the push rod 44 at the waist 50 when the pushrod 44 is installed in the nose extension 52. The set screw 54 is screwed in so that the end of the set screw 54 is just short of touching the waist 50 of the push rod 44. Accordingly, the plunger assembly 33 is restrained within the nosepiece assembly 62 by the set screw's 54 interference with the waist 50 of the pushrod 44.

The compression spring 56 and spring washer 58 are held in biased engagement against the head 64 of the nose extension 52 by the adjustment barrel 60 and the push rod 44, threaded into the adjustment barrel 60 so that the spring 56 urges the plunger assembly 33 in a direction away from the aperture 21. As a result, the longitudinal position of the plunger assembly 33 with relation to the nosepiece assembly 62 can be adjusted by threading the push rod 44 in and out of the adjustment barrel 60. Accordingly, the depth of a crimp in the ferrule can be controlled by adjusting the effective length of the plunger assembly 33, so the indenter 34 is adjusted to extend further distally to create a deeper crimp, or is adjusted to extend proximally to create a shallower crimp. To facilitate adjustments, the adjustment barrel 60 is radially bored with a series of openings 66 around the circumference of the adjustment barrel 60 near the proximal end to allow insertion of a longitudinal member (not shown). The longitudinal member can be inserted radially into one of the openings 66 to rotate the adjustment barrel 60 (threading the barrel onto or away from the pushrod 44) to perform plunger assembly positioning adjustments, such as to compensate for wear or manufacturing tolerance.

The plunger assembly 33 and the nosepiece assembly 62 are assembled into the nose 32 as described below. The proximal end of the nose 32 is inserted into the body 28 at the nose assembly opening 68 so that the head 64 of the nose extension is entirely inserted within the body 28. A nose collar 72, bored with an aperture 76 to allow the distal end of the nose extension 52 to pass through is installed over the nose extension 52 to slidably retain the proximal end of the nose 32 within the body 28 at the flange 65. The aperture 76 can be circumferentially grooved to allow biased mounting of an appropriately sized o-ring 74 to support the shaft of the nose extension 52 as it passes through the aperture 76. Once the nose collar 72 is installed over the nose extension 52 and the proximal end of the nose 32 is inserted in the body 28, the collar 72 is screwed to the body 28 with screws 78. Accordingly, the nose 32 can be rotated about an elongate axis by depressing the nosepiece 22 in a direction to compress the spring 56 to disengage the flange 65 from frictional contact with the nose collar 72 and allow the nose 32 to be rotatably positioned at a desired orientation. Advantageously, removal and replacement of the nose 32, such as to install a different sized nosepiece 62, can be easily accomplished by removing the nose collar 72 and installing another nose 32.

The body 28 is adapted to be mounted on a hydraulically operated base tool 26 to actuate the plunger assembly 33. Generally, the base tool 26 includes a piston 27, mounting ears 25, a hydraulic reservoir 27A, a pump lever 26A and a release lever 26B. The piston 27 is actuated by repeatedly operating the pump lever 26A, and the hydraulic pressure applied to the piston 27 is released by operating the release lever 26B. The release lever 26B causes hydraulic fluid built up behind the piston 27 during actuation to be drained off, releasing pressure on the piston 27 and allowing the piston 27 to be returned to a retracted position, such as by the spring 56 acting on the adjustment barrel 60 urging the piston 27 to the retracted position after the release lever 26B is activated. In an aspect of the invention, the body 28 is configured to be attached to the mounting ears 25 of the base tool 26 so that the body 28 is held in fixed relation to the base tool, and the piston 27 operates coaxially with the elongate axis of the nose assembly to apply force along the elongate axis of the plunger assembly 33. Accordingly, when the body 28 of the safety cable tool 10 is mounted on the hydraulically operated base tool 26, the crimping of the ferrule 20 and severing of the cable 12 is accomplished by operating the pump lever 26A of the base tool. In another aspect of the invention, the piston 27 travel is limited, for example by a stop within the base tool 26, so that the piston 27 is prevented from pushing the indenter 34 too far into the nose 32 and keeps the spring 56 from being over compressed.

While the invention has been described in what is presently considered to be a preferred embodiment, various modifications and variations will become apparent to those skilled in the art. It is intended therefore that the invention not be limited to the specific disclosed embodiment but be interpreted within the full spirit and scope of the appended claims.

What is claimed is:

1. A tool for tensioning safety cable to a predetermined tension limit, the tool comprising:

a body adapting for operatively mounting the tool to a power assisted tool;

a wheel and a faceplate attached thereto and mounted for rotation about an axis of the body substantially perpendicular to an elongate axis of the body for retaining cable wrapped around the wheel and allowing tension to be applied to the cable by rotation thereof, the wheel having a flared portion for wedging a cable against the faceplate and preventing tangential slipping of the cable about the wheel;

a clutch, operatively connected to the wheel, for transferring a rotational force to the wheel, the clutch preventing rotational force from being applied to the wheel when a predetermined cable tension has been reached;

an elongated nose extending from an end of the tool, a distal end of the nose having an aperture for passing the safety cable therethrough generally transverse to an elongate direction of the nose, the nose further having a passageway extending from a proximal end of the nose in the elongate direction to an intersection with the aperture, the proximal end of the nose being retained in the body;

a plunger assembly mounted in the passageway in the nose for reciprocating motion therein, the plunger assembly having at least a portion thereof extending from the body into the passageway in the nose, the plunger assembly actuated by the power assisted tool;

a barrel attached adjacent an end of the at least a portion of the plunger assembly between the nose and the body;

a spring positioned about the at least a portion of the plunger assembly, the spring being generally compressed between the proximal end of the nose and the barrel for urging the plunger assembly in a direction away from the aperture; and a collar fixed to the tool for retaining the proximal end of the nose therein, the nose being slidably retained to the body and rotatable about the elongate direction for aligning the aperture at selected angular directions transverse to the elongate direction.

2. The tool of claim 1 wherein the clutch further comprises:

a knob for applying a rotational force to the wheel; and a clutch ring, attached to the knob for transferring rotational force to the wheel and prohibiting transfer of rotational force to the wheel when a predetermined rotational force is applied to the knob.

3. The tool of claim 1 wherein the nosepiece comprises alignment means for angularly aligning the plunger in a fixed angular orientation within the nosepiece for rotation therewith.

4. The tool of claim 1 wherein the plunger assembly includes a reciprocal movement limiting means for slidably retaining the plunger assembly within the nose.

5. The tool of claim 1 wherein the proximal end of the nose includes a radially extending flange for engaging the collar and;

wherein an end of the plunger assembly, when operatively mounted on the power assisted tool, is in abutting contact with a piston on the power assisted tool for maintaining the plunger assembly in a fixed position when the nose is depressed.

6. The tool of claim 5 wherein the nosepiece is axially moveable by depressing the nosepiece in a direction to compress the spring to displace the flange to enable rotation of the nosepiece about the elongate direction.

7. A tool for tensioning safety cable to a mechanically set tension limit and for terminating the cable when the cable has been tensioned to the mechanically set limit, the tool including a manual actuator for gripping and pulling the cable to the tension limit, and a hydraulically assisted actuator for crimping a ferrule onto the cable when the tension limit has been reached, the hydraulically assisted actuator being operative to sever a free end of the cable concurrently with crimping of the ferrule, the manual actuator comprising a wheel and a faceplate attached thereto and mounted for rotation about an axis of the body substantially perpendicular to an elongate axis of the body for retaining cable wrapped around the wheel and allowing tension to be applied to the cable by rotation thereof, the wheel having a flared portion for wedging a cable against the faceplate and preventing tangential slipping of the cable about the wheel.

8. The tool of claim 7, further comprising a clutch for transferring a rotational force to the wheel, the clutch preventing rotational force from being applied to the wheel when a predetermined cable tension has been reached.

9. The tool of claim 7, the hydraulically assisted actuator further comprising a plunger for progressively crimping the ferrule as the hydraulically assisted actuator is operated.

10. The tool of claim 9, the hydraulically assisted actuator further comprising a shearing edge, operative in conjunction with a ferrule edge, for severing the free end of the cable as the ferrule edge is forced past the shearing edge by the plunger as the ferrule is being crimped.

11. The tool of claim 9, wherein the manual actuator further comprises a tensioning wheel for retaining cable wrapped around the wheel and allowing tension to be applied to the cable by manual rotation thereof.

12. The tool of claim 10, further comprising:

a clutch for transferring a rotational force to the wheel, the clutch preventing rotational force from being applied to the wheel when a predetermined cable tension has been reached.

* * * * *